United States Patent [19]

Worthen et al.

[11] 4,351,292

[45] Sep. 28, 1982

[54] POPPET VALVE SHIELD

[75] Inventors: Roger P. Worthen, Farmington Hills; Jay M. Larson, Marshall, both of Mich.

[73] Assignee: Eaton Corporation, Cleveland, Ohio

[21] Appl. No.: 193,679

[22] Filed: Oct. 3, 1980

[51] Int. Cl.[3] ..... F01L 3/20

[52] U.S. Cl. ..... 123/188 AA; 123/188 A

[58] Field of Search ..... 123/90.51, 188 R, 188 A, 123/188 AA, 668, 669; 29/156.7 R, 156.7 B

[56] References Cited

U.S. PATENT DOCUMENTS

| | | | |
|---|---|---|---|
| 1,218,317 | 3/1917 | Rich | 29/156.7 R |
| 1,449,876 | 3/1923 | Williams | 29/156.7 R |
| 1,601,274 | 9/1926 | Warrington | 123/188 A |
| 1,726,353 | 8/1929 | Jardine | 29/156.7 R |
| 1,868,133 | 7/1932 | Fisk | 123/188 A |
| 1,904,430 | 4/1933 | Ferrando et al. | 123/188 AA |
| 2,058,741 | 10/1936 | Taylor | 92/176 |
| 2,394,177 | 2/1946 | Hoern | 123/188 AA |
| 2,450,803 | 10/1948 | Johnson | 29/156.7 R |
| 2,513,939 | 7/1950 | Hoern | 123/188 AA |
| 2,788,570 | 4/1957 | Hoeh | 29/156.7 R |
| 2,840,427 | 6/1958 | Dolza | 92/176 |
| 2,947,582 | 8/1960 | Laagewaard | 92/176 |
| 3,408,995 | 11/1968 | Johnson | 123/668 |
| 3,473,444 | 10/1969 | Leffers | 92/176 |

*Primary Examiner*—Craig R. Feinberg
*Assistant Examiner*—W. R. Wolfe
*Attorney, Agent, or Firm*—C. H. Grace; F. M. Sajovec

[57] ABSTRACT

A thermal barrier (10) fixed to a valve head (12) of a diesel engine poppet valve (14) is disclosed. The barrier includes a thin sheet metal cap 18 having a concave shield portion 18*a*, an annular fold or corrugation (18*b*) circumscribing the shield portion, and a cylindrical skirt portion welded to the valve head. The cap and the face portion (12*a*) of the valve head define an evacuated chamber (20) which is preferably filled with an insulating material (24) which also provides structural support for the shield portion.

6 Claims, 1 Drawing Figure

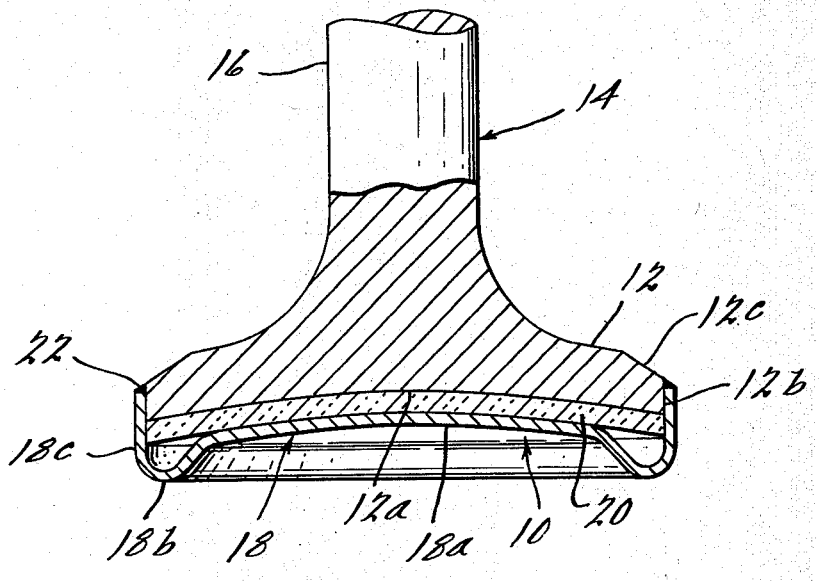
16
14
12
12c
22
12b
18c
12a
18b
18
18a
10
20

POPPET VALVE SHIELD

CROSS-REFERENCE TO RELATED APPLICATION

The application is related to U.S. Pat. No. 4,300,492 issued Nov. 17, 1981 assigned to Eaton Corporation which is a continuation of application Ser. No. 908,330 filed May 22, 1978 now abandoned.

BACKGROUND OF THE INVENTION

1. Field of the Invention

This invention relates to a thermal barrier and more specifically to a thermal barrier for a poppet valve used in a combustion chamber of a piston engine.

2. Description of the Prior Art

Shields or thermal barriers for protecting poppet valves in piston engine combustion chambers are well-known. For many years such shields or barriers have been proposed for the purpose of reducing heat corrosion and weakening of the valve head, to improve or enhance combustion, to reduce heat conduction through the valve, etc. These and other purposes are provided by a poppet valve thermal barrier disclosed in the above mentioned U.S. Pat. No. 4,300,492. Therein, the thermal barrier includes a cup-shaped sheet metal cap having a flat shield portion spaced from the valve face and a cylindrical skirt portion welded to the valve head to define evacuated chamber. The chamber may be filled with an insulating material. The skirt portion, which is conductively connected to the relatively hot shield portion and the relatively cool valve head, has a temperature gradient over its length between the shield portion and valve head or weld. This gradient and radially outward forces from thermal expansion of the shield portion causes the skirt portion to expand varying amounts over its length in bellmouth fashion to relieve the stresses. In some applications the stresses may exceed desirable levels in spite of the bellmouth expansion of the skirt portion. Further, in some applications the flat shield portion may lift off of the face portion or the insulation disposed between shield portion and the face portion, whereby the shield portion oil-cans and fatigues due to the cyclic pressures in the combustion chamber. The lift-off is believed to be caused by stresses at the intersection of the shield and skirt portion.

SUMMARY OF THE INVENTION

An object of this invention is to relieve stresses in a sheet metal shield of a thermal barrier covering the face portion of a poppet valve head and welded to the valve head.

Another object of this invention is to prevent oil-canning of the sheet metal shield.

According to a feature of this invention a poppet valve includes a sheet metal member welded to the valve head and covering the face portion of the valve head to define an evacuated chamber and an annular fold or corrugation defined by a sheet metal shield to provide an annular expansion joint for relieving stresses in the sheet metal due to thermal expansion differences between the sheet metal member and the valve head.

According to another feature of the invention the shield is further provided with a concave portion circumscribed by the annular fold, whereby stresses in the sheet metal shield due to thermal expansion differences between the sheet metal member and the valve head will provide a force vector in the direction of the valve face.

BRIEF DESCRIPTION OF THE DRAWING

The invention is shown in the accompanying drawing in which the invention thermal barrier is shown covering the face portion of a partially shown poppet valve.

Certain terminology referring to the proposed environment and direction of components will be used in the following description. This terminology is for convenience in describing the disclosed embodiment and should not be considerered limiting in the appended claims unless the claims are explicitly so limited.

DETAILED DESCRIPTION OF THE DRAWING

Referring now to the drawing, therein is shown a thermal barrier 10 supported by a mushroom head 12 of a partially shown poppet valve 14. Valve 14 is intended for use as an exhaust valve or as an intake valve in an expansible chamber engine of the internal combustion type which cyclically compresses and combusts gaseous mixtures, e.g., a piston engine of the diesel or spark ignition type. Further, thermal barrier 10 may be used on a poppet valve having a fillet heat shield such as the fillet heat shield disclosed in application Ser. No. 182,472 filed Sept. 22, 1980 and incorporated herein by reference.

Valve 14 includes a partially shown stem 16 and the mushroom head 12 shown in section. The surface of head 12 includes a circular face portion **12*a*, a cylindrical wall portion 12*b*, and a frustoconical valve seat portion 12*c***. Circular face portion is preferably dished inward to define a concave surface.

Thermal barrier 10 includes a sheet metal member 18 having a concave shield portion **18*a* spaced from face portion 12*a*, an annular fold or corrugation portion 18*b* circumscribing the concave shield portion, and a cylindrical skirt portion 18*c* integrally formed with the shield and fold portions and extending completely around the periphery of the shield. Skirt 18*c* embraces or circumscribes face portion 12*a*, telescopes over cylindrical wall portion 12*b*, and defines in combination with the shield and fold portion and the face portion an evacuated chamber 20 which provides a thermal barrier for conductively insulating the face portion from combusting gases. The end of skirt portion 18*c* distal from the fold portion is welded to wall portion 12*b* by a continuous weld 22 which hermetically seals chamber 20. The welding may be done in a vacuum by an electron beam welder, whereby chamber 20** is evacuated during the welding process.

The evacuated chamber 20 is preferably filled with an insulating material 24 to reduce radiator heat transfer across the chamber and to reinforce the shield. One insulating material, which has been tested and found to be a satisfactory insulator readily formed in a concave shape and an excellent reinforcement, is Zirconia Oxide. Another readily shaped insulating material, known to be an excellent insulation and reinforcement, is Min-K manufactured by Johns-Mansville Corporation. Cap 18 is preferably fabricated from a thin sheet metal alloy which is resistant to heat corrosion, such as Hastalloy-S. The thickness of the sheet metal is preferably as thin as possible commensurate with structural integrity to minimize added weight to the valve, to minimize heat transfer to the valve head via weld 22, and to facilitate fast warm-up of the cap. This last feature is believed to reduce fuel consumption and to improve exhaust emissions during engine warm-up. The cap is preferably annealed after forming to relieve work hardening of the metal.

Thermal barrier valves with caps 18 fabricated from Hastalloy-S in thicknesses of 0.040" have been successfully tested in diesel engines.

An important purpose of annular fold or corrugation **18*b* and skirt portion 18*c* is to relieve stresses caused by the difference in thermal expansion between shield portion 18*a* and valve head 12. When valve 14 is installed in an engine, shield portion 18*a*, which is in direct contact with combusting gases, may reach temperatures ranging from 500 to 1,000 Fahrenheit degrees greater than valve head 12, whereby shield 18*a* will tend to thermally expand radially outward greater amounts than head 12. Restricting the relative expansion between the shield portion and the valve head causes stressing of the shield portion and the weld. These stresses can cause stress failure of the shield and/or weld. Skirt portion 18*c* and fold portion 18*b* relieve these stresses. Skirt portion 18*c* is conductively connected to the shield portion and the valve head and therefore has a temperature gradient over its length. This gradient and radially outward forces from expansion of the shield portion cause a bellmouth expansion of the skirt portion at the hottest end of the skirt portion. The stresses due to thermal expansion of the shield are further reduced by making the skirt length as long as practicable with respect to the shield diameter. Skirt lengths 1/10 to 1/20 of the shield diameter have been satisfactorily tested in a diesel engine. In some applications the stresses may exceed desirable levels in spite of the bellmouth expansion of the skirt portion. Annular fold 18*b*** functions as an expansion joint to further reduce the stresses due to the expansion differences. The outer diameter of the fold portion extends the length of the skirt length and the crest of the fold hinges or gives similar to an accordion pleat.

An important purpose of the concave shape of shield portion 18 is to reduce an oil-canning tendency of the shield portion. As the shield portion expands against the fold and skirt portion, compression stresses build up in the shield. These stresses may be resolved into radiating force vectors acting normal to the axis of the valve stem, and into axial force vectors acting in the direction of the valve stem axis and toward the face portion. Hence, the axial force vectors apply a force biasing the shield portion toward the valve face.

The preferred embodiment of the invention has been disclosed for illustrative purposes. Many variations and modifications of the disclosed embodiment are believed to be within the spirit of the invention. The following claims are intended to cover the inventive portions of the disclosed embodiment and variations and modifications believed to be within the spirit of the invention.

What is claimed is:

1. An insulated poppet valve of the type including a mushroom head having a circular face portion normally exposed to combusting gases in a combustion chamber of an expansible chamber engine, a sheet metal member spaced from and extending over said face portion, an annular fold formed continuously around the periphery of said member terminating in a skirt portion welded to the periphery of said head, said face portion, said sheet metal member, annular fold and skirt portion defining an evacuated chamber which provides a heat-conduction barrier for insulating the valve face portion from combusting gases, said annular fold providing an annular expansion joint for relieving stresses in the sheet metal member due to thermal expansion differences between the member and the valve head.

2. An insulated poppet valve as claimed in claim 1, in which said sheet metal member includes a concave surface circumscribed by said annular fold which defines a dish portion extending toward the face portion.

3. An insulated poppet valve of the type including a mushroom head having a circular face portion normally exposed to combusting gases in a combustion chamber of an expansible chamber engine, a sheet metal cap covering the face portion, said cap having a circular shield portion spaced from and extending over said face portion, and a continuous skirt portion welded to the valve head, the improvement comprising:

an annular fold formed continuously at the periphery of said shield portion and said skirt portion, said face portion, shield portion, annular fold and skirt portion of said cap defining an evacuated chamber which provides a heat-conduction barrier for insulating the valve face portion from combusting gases, said annular fold providing an annular expansion joint for relieving stresses in the sheet metal due to thermal expansion differences between the shield portion and the valve head.

4. An insulated poppet valve as claimed in claim 3, in which said cap includes a concave surface circumscribed by said annular fold which defines a dish portion extending toward the valve face.

5. A valve as claimed in claims 1, 2, 3, or 4, in which the circular face portion of the head is concave.

6. A valve as claimed in claims 1, 2, 3, or 4, in which an insulating material is disposed in the evacuated chamber.

* * * * *